US007351044B2

(12) United States Patent
Antufjew et al.

(10) Patent No.: US 7,351,044 B2
(45) Date of Patent: Apr. 1, 2008

(54) MULTI-STAGE PISTON TYPE COMPRESSOR

(75) Inventors: Iwan Antufjew, Wohnsitz (DE); Marko Schrödter, Wohnsitz (DE); Stefan Beetz, Wohnsitz (DE)

(73) Assignee: Continental AG, Hannover (DE)

( * ) Notice: Subject to any disclaimer, the term of this patent is extended or adjusted under 35 U.S.C. 154(b) by 102 days.

(21) Appl. No.: 10/479,383

(22) PCT Filed: May 24, 2002

(86) PCT No.: PCT/DE02/01887

§ 371 (c)(1),
(2), (4) Date: Oct. 19, 2005

(87) PCT Pub. No.: WO02/095227

PCT Pub. Date: Nov. 28, 2002

(65) Prior Publication Data

US 2006/0104844 A1 May 18, 2006

(30) Foreign Application Priority Data

May 25, 2001 (DE) ..... 101 25 420

(51) Int. Cl.
*F04B 39/10* (2006.01)

(52) U.S. Cl. ..... 417/545; 417/555.1; 417/552

(58) Field of Classification Search ..... 417/545, 417/546, 555.1, 259, 260, 262, 525, 552, 417/440, 307; 251/149
See application file for complete search history.

(56) References Cited

U.S. PATENT DOCUMENTS

| | | | | | |
|---|---|---|---|---|---|
| 3,536,424 | A * | 10/1970 | Plos | 417/545 |
| T0,883,011 | I4 * | 2/1971 | Miller | 417/259 |
| 4,289,159 | A * | 9/1981 | Ehemann et al. | 137/454.4 |
| 4,532,685 | A * | 8/1985 | Itoh et al. | 417/550 |
| 4,846,633 | A * | 7/1989 | Suzuki et al. | 417/310 |
| 4,890,637 | A * | 1/1990 | Lamparter | 137/246 |
| 5,022,832 | A * | 6/1991 | Lauterbach et al. | 417/571 |
| 5,658,134 | A * | 8/1997 | Gagnon et al. | 417/262 |
| 6,056,439 | A * | 5/2000 | Graham | 383/103 |
| 2005/0031476 | A1* | 2/2005 | Antufjew et al. | 417/545 |

* cited by examiner

*Primary Examiner*—Devon C. Kramer
*Assistant Examiner*—Peter J Bertheaud

(57) ABSTRACT

In order to achieve a high level of impermeability with a low closing force for the sealing elements of a multistage piston compressor, the overflow channel (19) in the valve piston (9) opens into at least two passages (26, 27) and the sealing plate of the overflow check valve (20) that is located in the valve piston (9) is configured as a freely guided closing membrane (28) with a limited stroke. The passages (26, 27) of the overflow channel (19) have different diameters, are arranged on a graduated circle at a radial distance from the axis of the closing membrane (28) and are completely covered by the closing membrane (28).

7 Claims, 2 Drawing Sheets

MULTI-STAGE PISTON TYPE COMPRESSOR

BACKGROUND OF THE INVENTION

The invention relates to a multistage piston compressor comprising a valve casing and a shiftable valve piston formed as a single piece and driven linearly oscillating by a drive motor, wherein the multistage piston compressor is furnished with at least one volume changeable low-pressure chamber with an intake check valve and with at least one volume changeable high-pressure chamber with a discharge check valve, wherein the valve piston includes a low-pressure piston and a high-pressure piston and wherein the low-pressure chamber and the high-pressure chamber are connected to each other through an overflow duct, wherein an overflow check valve opening in the direction toward the high-pressure chamber is inserted in the overflow duct.

Such piston compressors are employed in all technical fields, where there exists a need for compressed air. Primarily such piston compressors are applied in the vehicle industry for pneumatic suspension and/or air damping.

Such a piston compressor in a two-stage construction is for example described in the German printed Patent document DE 197 15 291 A1. This piston compressor comprises a compressor casing, where a cylindrical low-pressure chamber with a larger low-pressure piston and a cylindrical high-pressure chamber with the smaller high-pressure piston are formed in the compressor casing. Here the low-pressure chamber and the high-pressure chamber are disposed on a common axis and the low-pressure piston and the high-pressure piston are formed to a single piece pressure piston with a common piston rod. The low-pressure chamber is furnished with an intake with an intake check valve, the high-pressure chamber is furnished with an outlet with a discharge check valve and the two pressure chambers are connected by an overflow channel, wherein an overflow check valve is disposed in the overflow channel. A crank pin of a crankshaft engages with the common piston rod of the low-pressure piston and of the high-pressure piston at a right angle alignment, wherein the crankshaft is driven for example by an electric motor and wherein the crankshaft transforms the rotary motion of the crankshaft into a linear motion at the single piece pressure piston. An oscillating motion results at the pressure piston from this linear motion.

The intake check valve, the discharge check valve, and the overflow check valve have sealing discs made of spring steel, wherein the sealing discs of the spring steel are attached by a middle screw as is the case with the intake check valve and with the overflow check valve and wherein the sealing discs of spring steel cover in a sealing way several flow channels disposed on a partial circle, or which sealing discs are held by a sideways staggered screw as is the case with the discharge check valve and which sealing discs seal off a next disposed flow channel.

These check valves perform their object only in an insufficient way. It is to be noted that the metallic sealing discs do not seal sufficiently. This can be traced to the fact that the closure and sealing force of the sealing discs is furnished exclusively by the proper tension of the spring steel. Frequently, a tensioning force acts opposite to the closure and sealing force, wherein the tensioning force starts from the attachment screw and prevents a smooth resting of the sealing disc in a pressure balanced state. Leaks occur also by the fact that fatigue situations occur at the sealing disc in the course of time and that the sealing discs to not rest perfectly at the sealing surface for this reason. The sealing discs are usually furnished stronger for balancing these disadvantageous effects. This in turn increases again the incorporation space of such a sealing disc and decreases the volume of the corresponding pressure chamber. Such piston compressor's are then not very powerful. The higher closure force obtained by reinforcing the sealing disc simultaneously increases however the required opening force for the free flow through, which opening force has to be furnished by the system pressure. This also decreases substantially the degree of effectiveness of the piston compressor. It has also become apparent that the material of the sealing discs fairly quickly fatigues because of the high frequencies of the piston compressor and therefore only a small lifetime of the sealing discs can be recorded.

Finally, the production of the sealing discs out of spring steel is very involved, since on the one hand the material is hard to work with and on the other hand high requirements are placed on the quality of the sealing face at the sealing disc.

Therefore it is an object of the present Invention to develop a piston compressor of the recited kind, wherein the check valves exhibit a low closure force and at the same time assure a high sealing effectiveness.

SUMMARY OF THE INVENTION

The object is achieved by a multistage piston compressor of the aforementioned kind with the following properties: The overflow duct joins at least two passage bore holes; the sealing disc of the overflow check valve is formed as a loosely guided and stroke limited sealing membrane; the passage bore holes of the overflow duct exhibit different diameters; the passage bore holes are disposed at an identical radial distance to the axis of the sealing membrane; and the passage bore holes are completely covered by the sealing membrane.

The new piston compressor eliminates the recited disadvantages of the state-of-the-art.

The Invention is to be explained in more detail by way of an embodiment example.

DETAILED DESCRIPTION OF THE DRAWINGS

Figure 1:
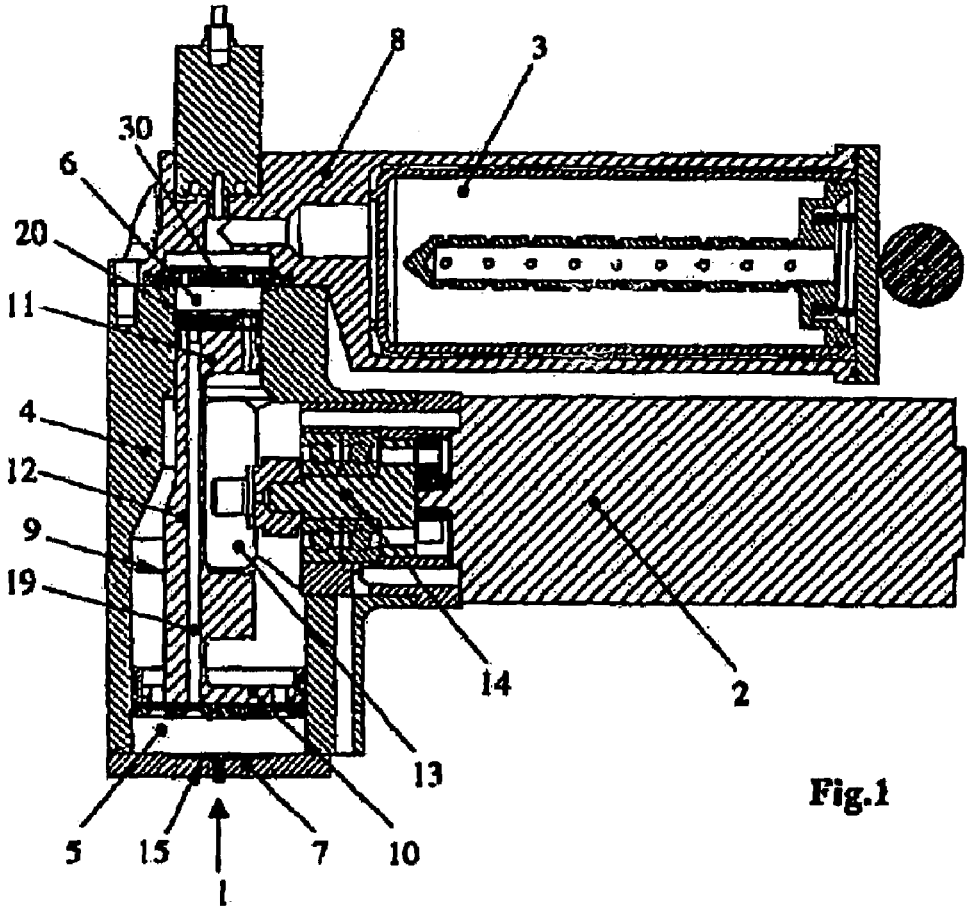
FIG. 1: shows a two-stage piston compressor in the schematic sectional presentation.

According to FIG. 1 a two-stage piston compressor comprises in its main components the piston compressor proper 1, a drive motor 2 and an airdrying unit 3.

A valve casing 4 with a cylindrical inner chamber stepped in its diameter belongs to the piston compressor 1, wherein the cylindrical inner chamber is subdivided into a low-pressure chamber 5 with a larger diameter and in a high-pressure chamber 6 with a smaller diameter. The low-pressure chamber 5 is sealingly closed to the outside with a valve casing floor 7 and the high-pressure chamber 6 is sealingly closed to the outside with a valve casing cover 8.

Here the valve casing cover 8 is connected to or formed as a single piece with the casing of the airdrying unit 3. A single piece compressor piston 9 is fitted into the inner chamber of the valve casing 4, wherein the compressor piston 9 correspondingly comprises a low-pressure piston 10 with a larger diameter, a high-pressure piston 11 with a smaller diameter, and a common piston rod 12. A crank case is formed in the outer region of the piston rod 12, wherein the connecting rod 13 of the crankshaft 14 of the drive motor 2 engages in right angle alignment in the crank case. The low-pressure chamber 5 and the high-pressure chamber 6 have connections among each other and toward the outside.

Figure 2:
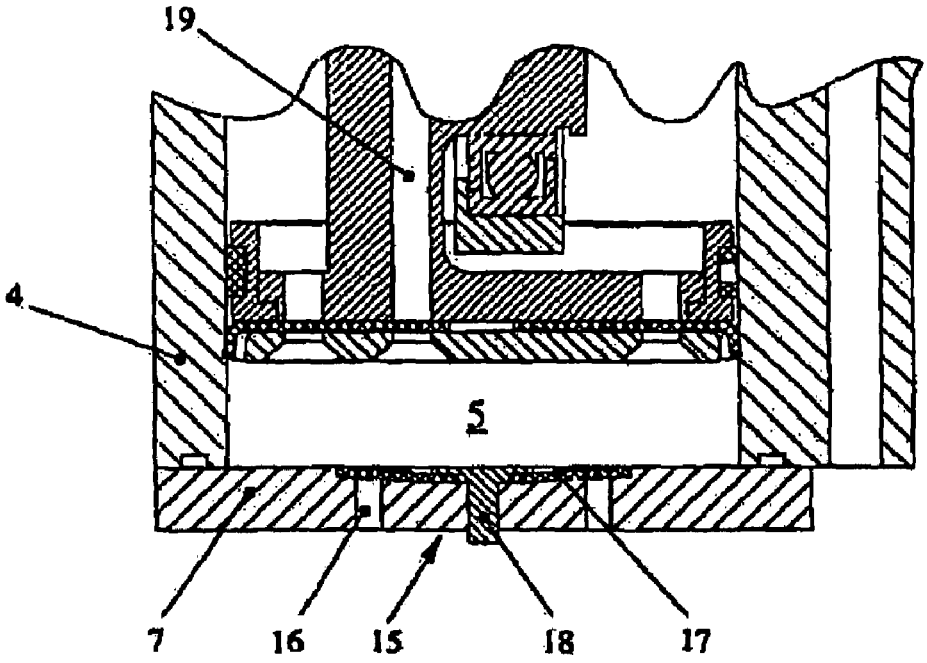
FIG. 2: shows a detail of the piston compressor with the presentation of the intake check valve.

An intake check valve 15 is thus disposed according to FIG. 2 in the valve casing floor 7 of the piston compressor 1, wherein the intake check valve 15 connects the low-pressure chamber 5 to the atmosphere. Several intake openings 16 disposed on a common circular path and a first sealing membrane 17 covering all intake openings 16 belong to the intake check valve 15. Here the sealing membrane 17 is fitted into an internally disposed sunk bore hole, wherein the sunk bore hole exhibits a ball shaped or an angular bore hole base. A mushroom like attachment element 18 placed in the middle fixes the sealing membrane 17 and maintains the sealing membrane 17 under a light tension on the base of the sunk bore hole. Here this tension entered through the attachment element 18 is selected such that the first sealing membrane 17 is capable of rotation in its position and does not protrude and lift off from the intake openings 16 in a pressure balanced state. In addition, the sealing membrane 17 and the attachment element 18 are inserted flush into the sunk bore hole in order not to lose any volume of the low-pressure chamber 5.

Thus, there is furthermore disposed a passing through overflow channel or duct 19, wherein the overflow duct 19 connects the low-pressure chamber 5 and the high-pressure chamber 6 to each other. And overflow check valve 20 is disposed in the high-pressure side joining region of this overflow duct 19 according to FIG. 3, wherein the overflow check valve 20 functionally connects to each other or separates from each other the low-pressure chamber 5 and the high-pressure chamber 6. For this purpose the joining region of the overflow duct 19 is expanded to a chamber 21 having a cross-section of kidney shape, wherein the kidney shape follows a circular path.

The overflow check valve 20 comprises a pot collar 22 made out of plastic, wherein the pot collar 22 with its floor rests on the front face of the high-pressure piston 11 and rests sealingly at the inner wall of the high-pressure chamber 6. The pot collar 22 is broken out in the region of the overflow duct 19.

Figure 4:
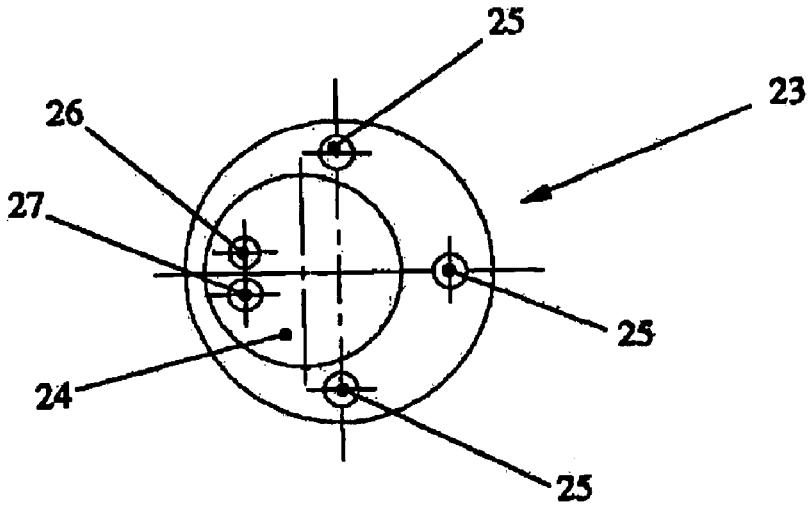
FIG. 4: shows a top planar view of the valve inserts belonging to the overflow check valve.

A particularly formed valve support 23, which is inserted fittingly into the inner space of the pot collar 22 and which is shown in more detail in FIG. 4, furthermore belongs to the overflow check valve 20. This valve support 23 consequently has an outer shape which is directed to the inner chamber of the pot collar 22. A cylindrical recess 24 is inserted from the side of the high-pressure chamber 6, wherein the axis of the cylindrical recess 24 is disposed remote from the axis of the high-pressure piston 11 by a certain eccentricity amount. This eccentricity amount as well as the size and the radial position of the cylindrical recess 24 assure, that the cylindrical recess 24 is disposed overlapping with the chamber 25 having kidney shape. The valve support 23 is equipped outside of the cylindrical recess 24 with the distributedly disposed attachment element 25 for a position determining anchoring with the high-pressure piston 11.

A first passage bore hole 26 with a smaller diameter and a second passage bore hole 27 with a larger diameter are disposed in the outer radial region of the cylindrical recess 24, wherein the first passage bore hole 26 and the second passage bore hole 27 exhibit an equal or different distance to the axis of the cylindrical recess 24 and wherein the first passage bore hole 26 and the second passage bore hole 27 are formed such in their position and their extension that they are disposed overlapping with the chamber 21 having kidney shape of the overflow duct 19. Further passage bore holes can be employed in the same kind in addition to the first passage bore hole 26 and the second passage bore hole 27. A freely resting second sealing membrane 28 is fitted with such play into the cylindrical recess 24 that the second sealing membrane 28 is freely movable in the rotary direction and in axial direction and such that the annular intermediate space between the second sealing membrane 28 and the inner wall of the cylindrical recess 24 are suitable for air passage. The neighboring edges of the cylindrical recess 24 and of the second sealing membrane 28 are rounded off or, respectively, performed along broken lines.

Furthermore, the cylindrical recess 24 is covered with a stop grid 29, wherein the stop grid 29 delimits on the one hand the axial stroke of the second sealing membrane 28 and on the other hand furnishes a substantially free passage to the released compressed air stream. Here the structure of the grid stays is freely selected, wherein the breakouts in the stop grid 29 are provided of such small size that the second sealing membrane 28 cannot become clamped. The breakouts can also be of different size.

Figure 3:
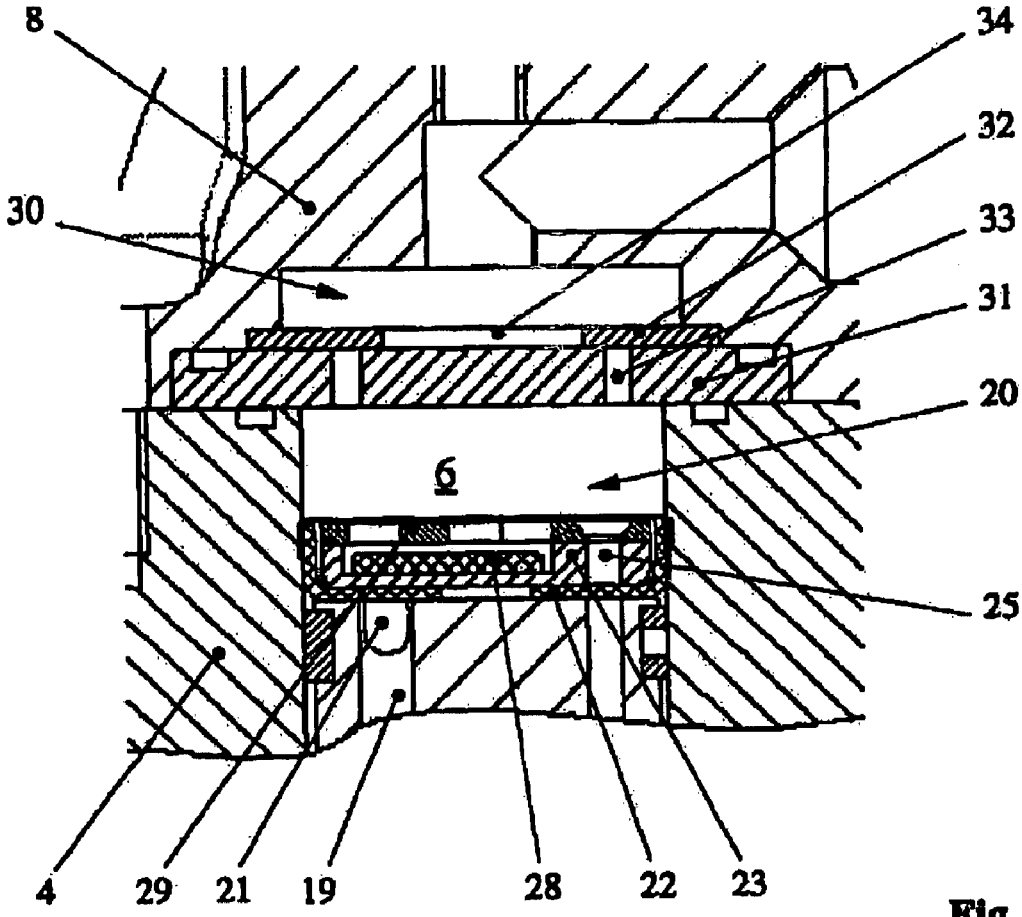
FIG. 3: shows a detail of the piston compressor with the presentation of the overflow check valve and of the discharge check valve.

The high-pressure chamber 6 furthermore exhibits a discharge check valve 30 or connecting the high-pressure chamber 6 to a user line. This discharge check valve 13 according to FIG. 3 is disposed between the valve casing 4 and the valve casing cover 8 and comprises a valve plate 31 clamped at the circumference and a third sealing membrane 32. The valve plate 31 is sealed relative to the valve casing 4 and relative to the valve casing cover 8 and is furnished with several outlet openings 33 disposed on a common part circle. The third sealing membrane 32 is formed as a ring and correspondingly exhibits a middle flow-through bore hole 34. The third sealing membrane 32 is held fixedly between the valve plate 31 and the valve casing cover 8, while the flow-through bore hole 34 is formed with its diameter sufficiently smaller as the partial circle diameter of the outlet openings such that the outlet openings 33 are fully covered by the third sealing membrane 32.

The third sealing membrane 32 is built in without constructive pretension such that a sealing force results only from the material specific own proper tension. The first sealing membrane 17 of the intake check valve 15, the second sealing membrane 28 of the overflow check valve 20 and the third sealing membrane 32 of the discharge check valve 30 are made out of plastic and in particular out of an elastic polymer, which elastic polymer is furnished mainly with a high rupturing strength, which is elastic polymer is highly stable relative to temperature and which elastic polymer exhibits elastic properties with memory effect.

The rotary motion of the crankshaft 14 driven by the drive motor 2 is transformed through the connecting rod 13 into an oscillating linear motion during the operation and the oscillating linear motion is transferred to the compressor piston 9. Therewith the low-pressure piston 10 and the high-pressure piston 11 move in the same way between two oppositely disposed return points and this way form two low-pressure chamber 5 and high-pressure chamber 6 alternatingly changing in volume.

Such an underpressure is generated here while the low-pressure chamber expands, where the underpressure lifts the first sealing membrane 17 at its outer circumference and allows outer air to flow in through the intake openings 16. This opening pressure results from the sum of the material tension of the sealing membrane 17 and the incorporation caused pretension at the sealing membrane 17. At the same time the under pressure closes the second sealing membrane 28 of the overflow check valve 20.

A balanced pressure between the low-pressure chamber 5 and the atmosphere occurs at the first sealing membrane 17 at the upper turning point of the motion of the compressor piston 9, whereby the sealing membrane 17 is pressed by the recited forces of the pretensioning onto the intake openings 16 and closes the intake openings 16. Lowest passage resistances occur based on the optimum selection of the material tensions and the incorporation tensions on the one hand during suctioning in and on the other hand the first sealing membrane 17 closes in a shortest time after the reaching of the upper turning point. This improves substantially the degree of effectiveness of the piston compressor.

The low-pressure chamber 5 is decreased in size with the reverse motion of the compressor piston 9 such that the tensioned air in the low-pressure chamber 5 is transported under pressure through the overflow channel 19 to the high-pressure chamber 6. Here the air flows initially into the kidney shaped chamber 21 of the overflow duct 19 and charges from there the second sealing membrane 28 in the region, in the periphery and in the circumference of the first passage bore hole 26 and of the second passage bore hole 27. A first opening force therewith operates through the first passage bore hole 26 and a second opening force operates through the second passage bore hole 27 onto the second sealing membrane 28, wherein the first opening force and the second opening force both operate parallel to each other. These two forces are so different, as are the cross sections of the two passage bore holes 26 and 27. The freely disposed second sealing membrane 28 is thereby brought into an inclined position and into a rotary motion based on the tangential force components, wherein the radial rotary motion is directed from the smaller passage bore hole 26 to the larger passage bore hole 27 and wherein the radial rotary motion continuously changes the position of the second sealing membrane 28 relative to the two passage bore holes 26, 27. This increases decisively the lifetime of the second sealing membrane 28, since the load of the material of the sealing membrane 28 is distributed continuously and therewith a premature overloading of only a certain position of the sealing membrane 28 is avoided. Such an overloading leads quickly to rupturing and to a failure of the overflow check valve 20. The freely disposed second sealing membrane 28 presents only a lowest resistance to the compressed air stream flowing through.

A balanced pressure between the low-pressure chamber 5 and the high-pressure chamber 6 prevails again at the lower return point of the motion of the compressor piston 9, wherein the balanced pressure allows the overflow check valve 20 to close. The closing occurs extremely quick as a reaction based on the free and low friction guiding of the second sealing membrane 28.

The compressed air enclosed in the high-pressure chamber 6 is displaced through the discharge check valve 30 with the motion of the compressor piston 9 reducing the high-pressure chamber 6. Here the compressed air passes the discharge openings 33 released by the third sealing membrane 32. The discharge check valve 30 again closes in an extremely quick reaction at the upper return point of the motion of the compressor piston 9.

LIST OF REFERENCE CHARACTERS

1 piston compressor
2 drive motor
3 airdrying unit
4 valve casing
5 low-pressure chamber
6 high-pressure chamber
7 valve casing floor
8 valve casing cover
9 compressor piston
10 low-pressure piston
11 high-pressure piston
12 piston rod
13 connecting rod
14 crankshaft
15 intake check valve
16 intake openings
17 first sealing membrane
18 attachment element
19 overflow duct
20 overflow check valve
21 kidney shaped chamber
22 pot collar
23 valve support
24 cylindrical recess
25 attachment element
26 first passage bore hole
27 second passage bore hole
28 second sealing membrane
29 stop grid
30 discharge check valve
31 valve plate
32 third sealing membrane.
33 outlet opening
34 flow-through bore hole

The invention claimed is:

1. A multistage piston compressor comprising a valve casing (4) and a shiftable valve piston (9) formed as a single piece and driven linearly oscillating by a drive motor (2), wherein the valve piston (9) is furnished with a low pressure piston (10) and with a high pressure piston (12), wherein the low pressure piston (10) and the high pressure piston (11) form at least one volume changeable low-pressure chamber (5) with the intake check valve (15) and with at least one volume changeable high-pressure chamber (6) with the discharge check valve (30), and wherein the low-pressure chamber (5) and the high-pressure chamber (6) are connected to each other through an overflow duct (19), wherein an overflow check valve (20) opening in the direction toward the high-pressure chamber (6) is inserted in the overflow duct (19), wherein the overflow check valve (20) is equipped with a sealing disc, wherein the overflow duct (19) joins at least two passage bore holes (26, 27), wherein the sealing disc of the overflow check valve (20) is formed as a loosely guided and stroke limited sealing membrane (28), wherein the passage bore holes (26, 27) of the overflow duct (19) exhibit different diameters and wherein the passage bore holes (26, 27) are disposed at an identical radial distance to the axis of the sealing membrane (28) and wherein the passage bore holes (26, 27) are completely covered by the sealing membrane (28).

2. The multistage piston compressor according to claim 1, wherein the sealing membrane (28) is fitted into a recess (24) of a valve support (23) and wherein the sealing membrane (28) is covered by a stop grid (29).

3. The multistage piston compressor according to claim 2, wherein the two passage bore holes (26, 27) go through the valve support (23) and open into the recess (24) of the valve support (23).

4. The multistage piston compressor according to claim 1, wherein the sealing membrane (28) comprises an elastic polymer with memory properties.

5. The multistage piston compressor according to claim 4, wherein the intake check valve (15) is equipped with a first sealing membrane (17) and wherein the discharge check valve (30) is equipped with a third sealing membrane (32) and wherein the two sealing membranes (17,32) comprise an elastic polymer with equal properties.

6. The multistage piston compressor according to claim 5, wherein the intake check valve (15) comprises a valve case floor (7) with an inner face provided with a sunk bore hole and is equipped with several intake openings (16) disposed on a partial circle, wherein the intake sealing membrane (17) is fitted into the sunk bore hole and wherein the intake sealing membrane (17) is fixed under tension by a centrally placed and mushroom shaped attachment element (18), wherein the attachment element (18) immerses only to such an extent into the sunk bore hole that the attachment element (18) closes flush with the inner face of the valve case floor (7) and wherein the first sealing membrane (17) is only pretensioned by the attachment element (18) to such an extent that the sealing membrane (17) still remains rotatable.

7. The multistage piston compressor according to claim 5, wherein the discharge check valve (30) is furnished with several outlet openings (33) disposed on a common part circle, wherein the discharge openings (33) are entered into a valve plate (31), wherein the valve plate (31) is tensioned between the valve casing (4) and a valve casing cover (8) and wherein the third sealing membrane (32) is formed as a ring and is held with the outer circumference of the third sealing membrane (32) without tension between the valve plate (31) and the valve casing cover (8), wherein the third sealing membrane (32) with its inner circumference covers over the outlet openings (33).

* * * * *